US006332065B1

(12) United States Patent
Howard

(10) Patent No.: US 6,332,065 B1
(45) Date of Patent: Dec. 18, 2001

(54) CRU/TONER BOTTLE CONNECTOR ASSEMBLY

(75) Inventor: John Leroy Howard, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/713,862

(22) Filed: Nov. 17, 2000

(51) Int. Cl.[7] ..... G03G 15/08

(52) U.S. Cl. ..... 399/106; 141/364; 222/DIG. 1; 399/258; 399/262

(58) Field of Search ..... 399/258, 260, 399/262, 102, 103, 106; 222/DIG. 1; 141/363, 364, 383

(56) References Cited

U.S. PATENT DOCUMENTS 4,060,105 * 11/1977 Feldeisen et al. ..... 141/363 X
4,304,273 * 12/1981 Caudill et al. ..... 141/364 X
5,111,976 * 5/1992 Ban ..... 141/364 X
5,710,963 * 1/1998 Dirx ..... 399/262
6,236,826 * 5/2001 Kurz et al. ..... 399/258

* cited by examiner

*Primary Examiner*—Sophia S. Chen
(74) *Attorney, Agent, or Firm*—Perman & Green, LLP

(57) ABSTRACT

A toner-dispensing container assembly for attachment to a toner compartment cover on an electrographic printing machine to supply toner composition to the toner receiving compartment while avoiding detachment and spillage. The toner-dispensing container assembly is fastenable over the toner compartment cover and rotatable to a first position to open the cover to the toner compartment while the toner-dispensing container remains sealed. Further rotation of the toner dispensing container to a second position opens it to the toner-receiving compartment to dispense toner thereinto.

8 Claims, 4 Drawing Sheets

CRU/TONER BOTTLE CONNECTOR ASSEMBLY

BACKGROUND OF THE INVENTION

1. Field of the Invention

The present invention relates to electrophotographic copying machines which employ and consume xerographic toner powders or developers for the development of electrostatic images during the production of copies of imaged originals.

More particularly, the present invention relates to improved assemblies for the attachment and periodic replacement of filled toner containers to the housing of a toner cartridge comprising a compartment from which toner is metered to the image-development station of an electrophotographic copying machine.

2. State of the Art

In known electrophotographic machines having refillable toner compartments designed to be refilled or replenished by the user pouring toner thereinto from a toner container, there is substantial risk of toner spillage and waste, and of contamination of the machine, the work environment and the user.

Reference is made to U.S. Pat. No. 5,383,502 for its disclosure of a toner-supply container having a lid which is automatically opened to dispense toner into a toner-metering compartment of a copying machine when the toner container lid is moved into engagement with an unlatching mechanism, providing clean and automatic toner replenishment.

Reference is also made to U.S. Pat. Nos. 5,797,073 and 5,852,760 which disclose motor-driven toner containers for metering toner particles to the developer unit of an electrophotographic copying machine. Both of these patents disclose rotatable toner-supply containers which interlock with the toner storage unit of the machine and have an aperture from which toner is metered with each horizontal rotation of the supply containers.

The toner-supply containers of U.S. Pat. No. 5,797,073 incorporate a sealing means for the toner-release aperture, which sealing means is normally biased to seal the aperture when the container is separated from the apparatus, to prevent spillage of the toner before and during the connection of the toner supply container to the apparatus. Rotation of the container, during operation of the copy apparatus, causes the sealing means to be opened to permit metering of the toner composition into the toner storage compartment.

It is desirable to avoid the need for mechanically rotating the toner-supply container and therefore the modern electrostatographic machines incorporate vertically-supported toner-supply containers which feed toner composition into the toner-storage compartment of the apparatus by gravity flow. It is also necessary to preclude the premature release or spillage of the toner composition from such containers during attachment and/or detachment of the containers in vertical orientation from the apparatus.

SUMMARY OF THE INVENTION

The present invention provides a novel cover assembly for a toner composition-supply bottle adapted to be secured over the fill port of a toner-receiving compartment of an electrostatographic printing or copying machine, which means provides for proper alignment therebetween, support and stability therebetween and opening of the toner-supply bottle to the toner-receiving compartment only after the cover means assembly is locked to the housing of the CRU.

The present cover assembly includes a funnel section which is fastenable over the outlet end or mouth of a is toner-dispensing bottle, an intermediate annular docking ring section which is rotatably engaged over the outlet end of the funnel section and is rotatable between positions in which it seals and unseals the funnel section, and an annular mounting ring section which is secured to the CRU housing over the inlet cover to the toner-receiving compartment and which engages the intermediate cover sleeve section and the cover disk of the toner-receiving compartment for 180° rotation after which the toner bottle can be rotated 180° to align the funnel section opening with the aligned openings in the intermediate annular docking ring and the annular mounting ring section and the inlet cover of the toner-receiving compartment to permit gravity flow of the toner composition to fill the toner-receiving compartment.

Thus the present assembly assures that the toner bottle remains sealed until after the toner bottle assembly is aligned with the toner-receiving housing or cartridge, rotated to lock the components or elements thereof together and secure them to the housing, and then further rotated to open the toner-dispensing bottle.

DETAILED DESCRIPTION OF THE PREFERRED EMBODIMENT

Figure 1:
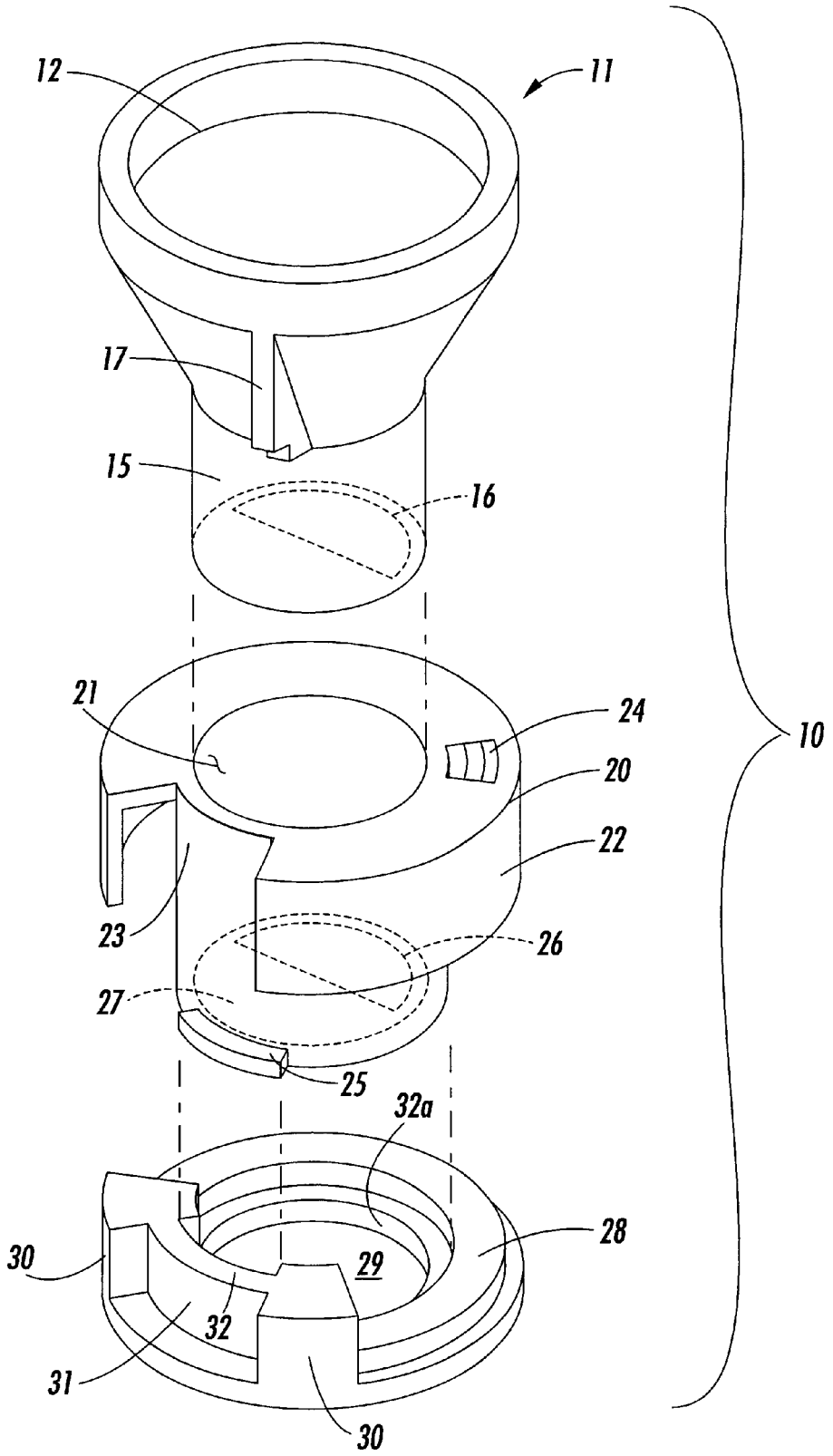
FIG. 1 is a perspective view of the toner bottle connector funnel element, intermediate docking ring element and the bottom mounting ring element of the present toner bottle cover means assembly according to a preferred embodiment of the present invention, with the sections shown in spaced relation for purposes of illustration.

Referring to FIG. 1, the present toner bottle cover and connector assembly 10 comprises a funnel section 11 having a bottle-engaging inlet end having a wall containing a peripheral catch rib 12 which interlocks with a peripheral annular rib or flange 13 on the toner bottle neck 14 to secure funnel section 11 to the bottle. The funnel section 11 incorporates a diagonal partition wall 15 which narrows the outlet end of the funnel to an offset hemispherical outlet port 16. The funnel section 11 also includes a vertical indicia means 17 for aligning the assembly with a corresponding indicia means 18 on the CRU housing 19, shown in FIG. 2 for initial attachment orientation.

The assembly 10 further includes an intermediate annular docking ring section 20 comprising a central sleeve element 21 which rotatably-engages the cylindrical outlet end of the funnel element 11, an upper peripheral collar element 22 having a front opening 23 and a rear stop member tab 24 which depends downwardly within the collar 22, and a lower alignment flange 25 which projects radially outwardly from the lower edge of the central sleeve element 21. Section 20 also has a lower central hemispherical floor section 26 having an offset outlet port 27. Floor section 26 underlies the opening 16 in the funnel section 11 to seal the funnel in starting position, shown in FIG. 1.

Finally, the cover assembly 10 includes a bottom annular mounting ring element 28 comprising a central opening 29 and a pair of closely-spaced wide wall sections 30 enclosing a narrow wall portion 31 forming an interior vertical slot 32 designed to receive the lower flange 25 of the docking ring section 20 when the latter is fitted down within the central opening 29 so that the wall sections 30 are received within the underside of the collar section 22 of the docking ring section 20. This permits the docking ring flange 25 to underlie the base wall of the mounting ring element 28 when the docking ring section 20 is rotated relative to the mounting ring element 28 thereby securing the elements 20 and 28 except when the flange 25 is aligned with the narrow wall portion 31, and vertical slot 32.

When the docking ring section 20 is assembled into the mounting ring element 28, the alignment flange 25 moves down the wall slot 32 into a peripheral inner ring slot 32*a* within which it is rotatable against the engagement projection 41 on the cover disk 39 of the toner receiving compartment to open and close the latter when the docking ring section 20 is rotated, within the limits of the stop member tab 24 in either direction.

Figure 2:
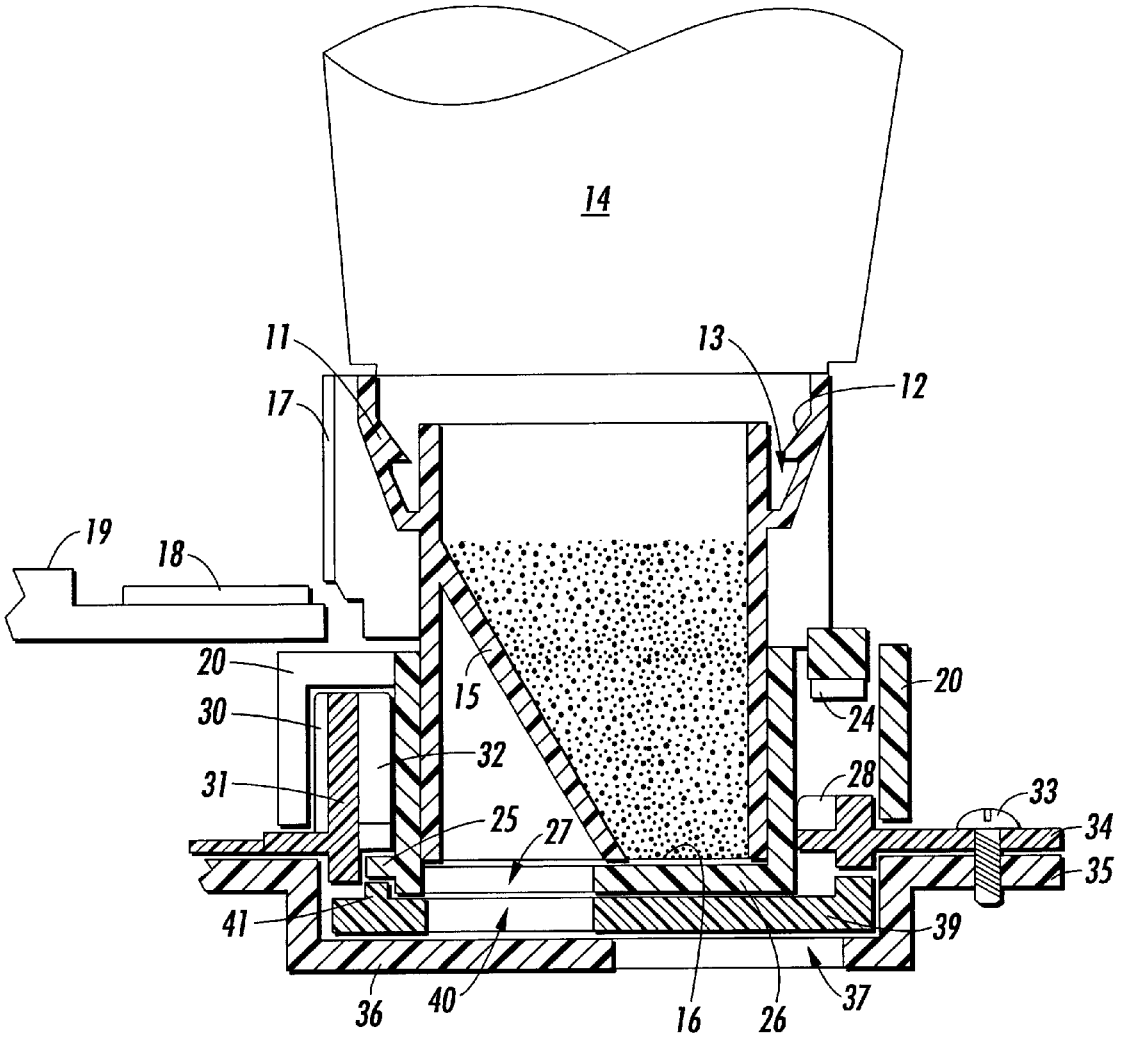
FIG. 2 is a cross-sectional view of the assembly of FIG. 1 with the funnel element secured to a toner-dispensing bottle and with the bottom mounting ring fastened to the housing of a CRU over the toner-inlet cover disk of a toner-receiving compartment, the assembly being aligned for attachment to the CRU and the container being sealed against the release of toner.
Figure 3:
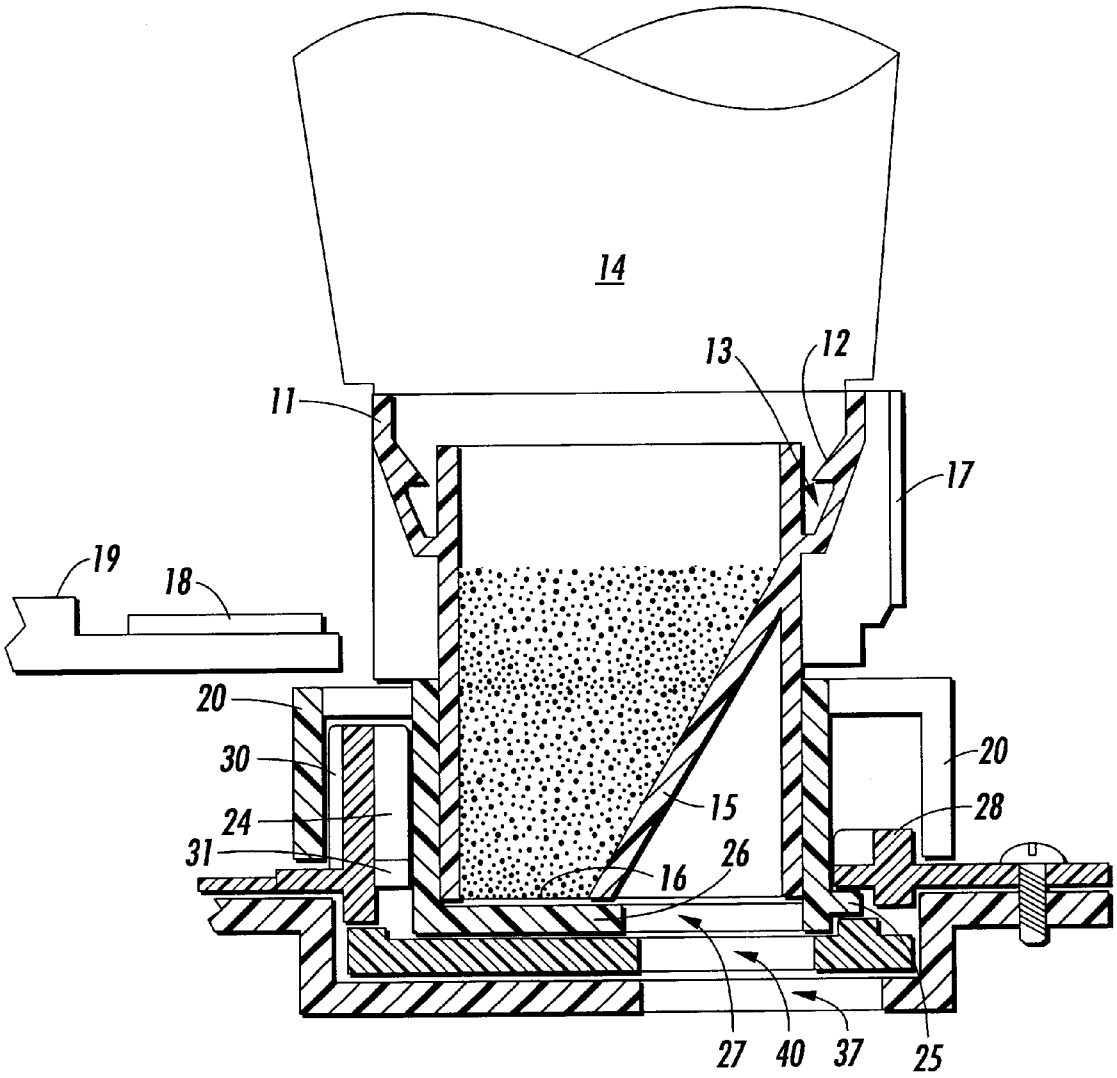
FIG. 3 is a cross-sectional view corresponding to FIG. 2 but with the toner bottle/funnel element and the docking ring member being rotated 180° to secure the funnel element and docking ring member to the mounting ring element and to rotate the toner-receiving compartment cover into open position.
Figure 4:
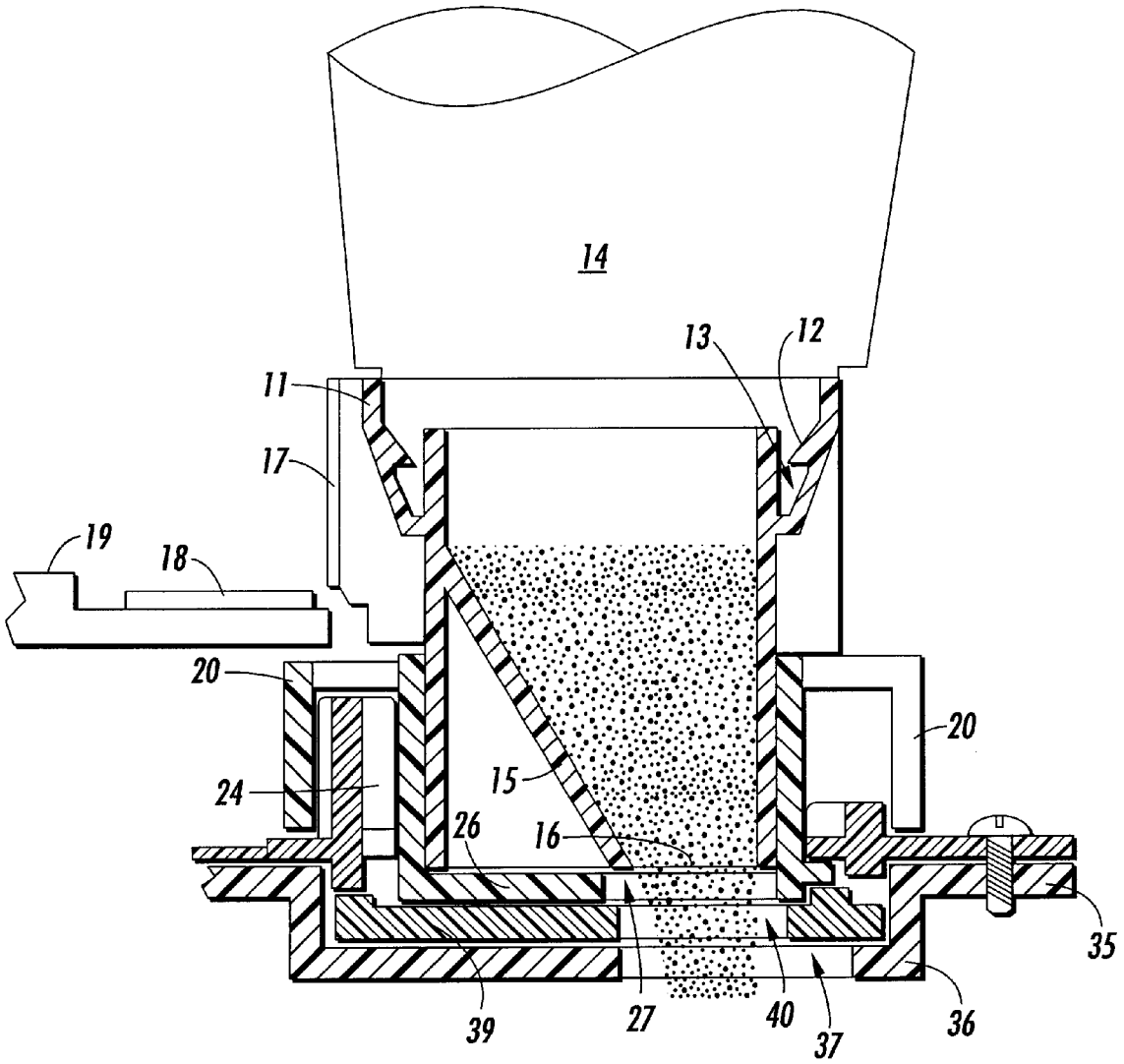
FIG. 4 is a cross-sectional view corresponding to FIG. 3 but with the bottle and funnel element rotated 180° within the intermediate docking ring element to position the open end of the funnel element in alignment over the open half-floor of the docking ring, the open half-floor of the sealing disk and the open half of the cover to the toner-receiving compartment, to permit gravity flow of the toner composition from the toner bottle to fill the CRU compartment.

The present assembly 10 is designed to be fastened to the toner-receiving compartment of an electrostatographic imaging machine, such as by means of a fastener 33 through a flange 34 on the mounting ring element 28 and secured to the machine housing 35, as shown in FIG. 2. The housing 35 includes a circular recessed inlet 36 having an offset inlet opening 37 and having a rotatable circular cover disk 39 which also has an offset opening 40. The cover 39 is provided with an upward projection or pin 41 which is engaged by the flange 25 of the docking ring section 20, during rotation thereof, to rotate the cover 39 by 180° into the position shown in FIG. 3 so that openings 27, 40 and 37 are aligned and stop member tab 24 engages the wide wall section 30 to prevent further rotation of the docking ring section 20.

In such position, the toner-dispensing container 14 is still sealed by the floor section 26 of the docking ring section 20 which underlies the open end 16 of the funnel section 11. However the funnel section 11 and engaged container 14 are still rotatable within the locked docking ring section to align the funnel opening 16 with the previously-aligned openings 27, 40 and 37 when the funnel section is rotated another 180°, to permit the gravity flow of toner composition from the supply container down into the toner-receiving compartment of the imaging machine.

The securement of the flange 25 of the docking ring section 20 locks it to the fastened mounting ring member 28 and prevents the frictionally-engaged funnel section 11 and fastened container 14 from tipping and spilling. Also the container 14 is maintained sealed during the first 180° rotation and is not opened until it is rotated a full 360°.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A toner bottle connector/toner compartment cover assembly for removably attaching a toner-dispensing bottle having a dispensing end to a toner-receiving compartment of an electrographic printing machine while avoiding spillage of toner, said assembly comprising:

(a) a toner bottle connector means comprising a funnel means having an inlet end comprising a wall which is fastenable to the dispensing end of a toner-supply bottle, and having a cylindrical bottom outlet end having an offset port;

(b) an intermediate docking ring member comprising a cylindrical body having a radial annular flange extending outwardly from the top area thereof and having a radial flange segment extending outwardly from the bottom outlet end thereof, the bottom outlet end of the cylindrical body having an offset outlet port, and the cylindrical outlet end of said funnel means being rotatably received within the cylindrical body of the docking ring member to align the offset outlet ports of said connector means and said docking ring member, and (c) an annular mounting ring element which is attachable over the opening of a toner-receiving compartment which is sealed by a rotatable sealing disk having an offset inlet opening, said ring element having a central opening surrounded by a cylindrical inner wall having a vertical slot formed therein, whereby the cylindrical body of said docking ring member is insertable within the central opening of said mounting ring element, with the radial flange segment passing through said vertical slot to a position underlying the cylindrical inner wall of said mounting ring element, whereby the docking ring member is rotatable within the mounting ring element to rotate the sealing disk of the toner receiving compartment to open position, so that the docking ring member and the mounting ring element must be relatively rotated to rotate the sealing disk and to align the offset ports of the docking ring member and of the rotated sealing disk, and thereafter the connector means and the docking ring member must be relatively rotated to align the offset ports thereof, to permit gravity supply of toner from the toner supply bottle into the toner receiving compartment.

2. The assembly according to claim 1 in which the toner bottle connector means is provided with an alignment means corresponding to an alignment means on the toner-receiving compartment, indicating that the outlet ports of the connector means and the docking ring member are not aligned and that the toner supply bottle is sealed.

3. The assembly according to claim 1 in which the cylindrical inner wall of said annular mounting ring element has areas of increased thickness enclosing said vertical slot, said areas engaging the top radial annular flange of the docking ring member to support the latter for rotation thereover.

4. The assembly according to claim 3 in which the top radial annular flange of the docking ring member has a depending stop member which engages said areas of increased wall thickness to limit the extent of relative rotation between said docking ring member and said mounting ring element in either direction.

5. An electrophotographic copying machine comprising a toner container/toner compartment cover assembly for removably attaching a toner-dispensing container to a toner-receiving compartment of said copying machine while avoiding spillage of toner, said copying machine comprising:

(a) a toner bottle connector means comprising a funnel means having an inlet end comprising a wall which is fastenable to the dispensing end of a toner-supply bottle having a dispensing end, and having a cylindrical outlet end having an offset port;

(b) an intermediate docking ring member having a top area and having a bottom outlet end, said ring member comprising a cylindrical body having a radial annular flange extending outwardly from the top area thereof and having a radial flange segment extending outwardly from the bottom outlet end thereof, the bottom outlet end of the cylindrical body having an offset outlet port, and the cylindrical outlet end of said funnel means being rotatably received within the cylindrical body of the docking ring member to align the offset outlet ports of said connector means and said docking ring member;

(c) an annular mounting ring element which is attachable over the opening of a toner-receiving compartment which is sealed by a rotatable sealing disk having an offset inlet opening, said ring element having a central opening surrounded by a cylindrical inner wall having a vertical slot formed therein, whereby the cylindrical body of said docking ring member is insertable within the central opening of said mounting ring element, with the radial flange segment passing through said vertical slot to a position underlying the cylindrical inner wall of said mounting ring element whereby the docking ring member is rotatable within the mounting ring element to rotate the sealing disk of the toner receiving compartment to open position, so that the docking ring member must be rotated relative to the mounting ring element to rotate the sealing disk and to align the offset ports of the docking ring member and of the rotated sealing disk, and thereafter the connector means must be rotated relative to the docking ring member to align the offset ports thereof, to permit gravity supply of toner from the toner supply bottle into the toner receiving compartment, and (d) a toner compartment cover member attachable over the opening of a toner-receiving compartment on the copying machine, said cover member comprising a peripheral rim member rotatably supporting said sealing disk between a first position in which it seals the toner-receiving compartment and a second position in which it uncovers the opening of the toner-receiving compartment, said annular mounting ring element rotatably attaching the intermediate docking ring member of the toner container/toner compartment cover assembly thereto, with the radial flange element of the intermediate docking ring member in engagement with the sealing disk of the cover member for rotation therewith to open and close the toner-receiving compartment.

6. An electrophotographic copying machine according to claim 5 in which the toner bottle connector means is provided with an alignment means corresponding to an alignment means on the toner-receiving compartment, indicating that the outlet ports of the connector means and the docking ring member are not aligned and that the toner supply bottle is sealed.

7. An electrophotographic copying machine according to claim 5 in which the cylindrical inner wall of said mounting ring element has areas of increased thickness enclosing said vertical slot, said areas engaging the top radial annular flange of the docking ring member to support the latter for rotation thereover.

8. An electrophotographic copying machine according to claim 7 in which the top radial annular flange of the docking ring member has a depending stop member which engages said areas of increased wall thickness to limit the extent of relative rotation between said docking ring member and said mounting ring element in either direction.

* * * * *